US005080824A

United States Patent [19]

Bindl et al.

[11] Patent Number: 5,080,824

[45] Date of Patent: Jan. 14, 1992

[54] CLEANER AND/OR CONDITIONERS CONTAINING ORGANOPOLYSILOXANES FOR GLASS-CERAMIC SURFACES

[75] Inventors: Johann Bindl; Franz Wimmer; Rudolf Kaufmann, all of Burghausen, Fed. Rep. of Germany

[73] Assignee: Wacker-Chemie GmbH, Munich, Fed. Rep. of Germany

[21] Appl. No.: 371,573

[22] Filed: Jun. 26, 1989

[30] Foreign Application Priority Data

Jul. 28, 1988 [DE] Fed. Rep. of Germany ..... 3825678

[51] Int. Cl.[5] ..... C11D 7/22; B08B 3/00

[52] U.S. Cl. ..... 252/174.15; 134/40; 252/171; 252/172; 252/173; 252/174.25; 252/DIG. 10

[58] Field of Search ..... 252/174.15, DIG. 10, 252/171, 172, 173, 174.25; 106/287.22; 528/15; 134/40

[56] References Cited

U.S. PATENT DOCUMENTS

| | | | |
|---|---|---|---|
| 3,562,786 | 2/1971 | Bailey et al. | 252/137 |
| 3,971,747 | 7/1976 | Bank et al. | 528/15 |
| 4,005,024 | 1/1977 | Rodriguez et al. | 252/174.15 |
| 4,005,025 | 1/1977 | Kinstedt | 252/174.15 |
| 4,005,028 | 1/1977 | Heckert et al. | 525/174.15 |
| 4,005,030 | 1/1977 | Heckert et al. | 525/174.15 |
| 4,026,826 | 5/1977 | Yoshida et al. | 106/287.22 |
| 4,035,411 | 7/1977 | Heckert et al. | 252/174.15 |
| 4,359,545 | 11/1982 | Ona et al. | 252/8.8 |
| 4,684,719 | 8/1987 | Ona et al. | 528/15 |
| 4,824,602 | 4/1989 | Juneja | 252/547 |
| 4,880,557 | 11/1989 | Ohara et al. | 252/174.15 |
| 4,940,626 | 7/1990 | Rhodes, III et al. | 428/198 |

FOREIGN PATENT DOCUMENTS

| | | |
|---|---|---|
| 0343304 | 12/1988 | European Pat. Off. . |
| 1061321 | 7/1959 | Fed. Rep. of Germany . |
| 2843234 | 10/1978 | Fed. Rep. of Germany . |
| 2952756 | 7/1981 | Fed. Rep. of Germany . |
| 3321289 | 12/1984 | Fed. Rep. of Germany . |
| 2105264 | 9/1971 | France . |
| 21058264 | 9/1971 | France . |
| 2200365 | 1/1987 | United Kingdom . |

*Primary Examiner*—Paul Lieberman
*Assistant Examiner*—A. Beadles-Hay

[57] ABSTRACT

The invention relates to a cleaner and/or conditioner for glass-ceramic surfaces which contains epoxide funcitonal organopolysiloxanes. The cleaner and/or conditioner may additionally contain other components, such as non-reactive organopolysiloxanes, surfactants, organic solvents, scouring agents, acid, additional additives and water, the composition being present as an oil-in-water or a water-in-oil emulsion.

10 Claims, No Drawings

CLEANER AND/OR CONDITIONERS CONTAINING ORGANOPOLYSILOXANES FOR GLASS-CERAMIC SURFACES

The invention relates to a cleaner and/or conditioners for glass-ceramic surfaces and more particularly to a cleaner and/or conditioner containing organopolysiloxanes for glass-ceramic surfaces.

BACKGROUND OF THE INVENTION

It is known that heat-resistant kitchen appliances for the household and industrial sector are manufactured to an increasing degree from glass-ceramic materials. In use, glass-ceramic cooking utensils in particular increasingly suffer from difficult-to-remove residues as a result of burning or even carbonization of foodstuffs spitting or boiling over. Without appropriate conditioning, the surface may be severely damaged by excessively vigorous scouring, and use of cleaning utensils such as glass scrapers can take chips out of the glass-ceramic surface, with consequent deterioration of the surface. In the case of foodstuffs with a high sugar content in particular, removal of the burnt-on food is virtually impossible without extensive damage to the surface.

The use of organopolysiloxanes in cleaning compositions, for example, solvents for window washing, car polishes, metal and textile cleaners, is well known. British Patent 1,172,479; British Patent 1,171,479; U.S. Pat. Nos. 3,681,122; and 4,124,523 all describe cleaners which consist of an organopolysiloxane, an alkali metal salt of the 3rd to 5th main group, a scouring agent and water as well as, if appropriate, a thickener and a nonionic surfactant. It is true that these formulations are in principle suitable for the cleaning of glass-ceramic surfaces, but their conditioning action in protecting the surface is wholly inadequate. In particular, the protective effect against burnt-on residues of foods with a high sugar content is insufficient. German Offenlegungsschrift 3,321,289 discloses a water-in-oil emulsion which consists of an amine functional organopolysiloxane, a cyclic dimethylpolysiloxane, a polysiloxane polyoxyalkylene block copolymer, a scouring powder, a surfactant and water. It is true that the cleansing action of this formulation is equally effective, yet again the protective effect of the amine functional organopolysiloxane contained therein as protective-film former is unsatisfactory, especially where the burnt-on food residues have a high sugar content. German Patent 2,952,756 discloses compositions which contain a polysiloxane containing metal oxides and/or amine groups, a scouring agent or a cleaner and additional surfactants. Even though the compositions in question have a cleansing and conditioning action, they have a short shelf-life due to a continuous increase in viscosity, poor polishability, and inadequate protection against burnt-on foods having a high sugar content. German Offenlegungsschrift 3,327,926 discloses an emulsion formulation which is composed of an amine functional polydimethylsiloxane, emulsifiers, acid components, a solvent, a scouring agent, protective-film improvers and water. It is true that the preparations in question have a cleansing and conditioning action, yet they suffer from the same disadvantages as those described in German Patent 2,952,756.

Therefore, it is an object of the present invention to provide a cleaning and conditioning composition which removes residues from glass-ceramic surfaces. Another object of the present invention is to provide a composition which acts as a conditioning agent for the cleaned glass-ceramic surfaces and to prevent or reduce the formation of difficult-to-remove residues. Still another object of the present invention is to prevent deterioration of the glass-ceramic surface. Still another object of the present invention is to provide a protective film on the glass-ceramic surface to reduce the adhesion of burnt-on food and allows the surface to be cleaned easily and gently at any time. A further object of the present invention is to provide a composition which can easily be applied and polished and has no tendency to produce smears and streaks. A still further object of the present invention is to provide an improved cleaner and/or conditioner for glass-ceramics which does not have the disadvantages of the prior cleaners and/or conditioners.

SUMMARY OF THE INVENTION

The foregoing objects and others which will become apparent from the following description are accomplished in accordance with this invention, generally speaking, by providing a cleaner and/or conditioner for glass-ceramic surfaces which contains organopolysiloxanes having epoxide groups. These organopolysiloxanes can be combined with other components to form oil-in water or water-in-oil emulsions.

DESCRIPTION OF THE INVENTION

The organopolysiloxanes containing epoxide groups which are used in this invention preferably contain units of the general formula $$R_aSiO_{\frac{4-a}{2}}, \quad \text{(I)}$$

or $$R_b(RO)_cSiO_{\frac{4-(b+c)}{2}}, \quad \text{(II)}$$

and $$R_d(RO)_eQ_fSiO_{\frac{4-(d+e+f)}{2}}$$

in which R represents a hydrocarbon group and Q represents an epoxide functional group; a is 1, 2 or 3; b is 0, 1 or 2; c is 1 or 2; d is 0, 1 or 2; e is 1 or 2; and f is 1 or 2; and in no case, are the totals of b and c and of d, e and f greater than 3.

Examples of radicals represented by R are alkyl groups having from 1 to 22 carbon atoms, alkoxyalkyl groups having from 1 to 22 carbon atoms, aryl groups having from 6 to 22 carbon atoms and alkaryl groups having from 7 to 22 carbon atoms.

The methyl, ethyl, methoxyethyl, phenyl and 2-phenylethyl groups are examples of the preferred R radicals.

The methyl radicals are examples of the particularly preferred R radicals.

Particularly preferred are epoxide functional-containing organopolysiloxanes of the formula $$(CH_3)_3SiO[(CH_3)_2SiO]_x[R^1R^2SiO]_y[QCH_3SiO]_z.Si(CH_3)_3$$

$R^1$ and $R^2$ represent an alkyl, aryl or alkaryl radical and Q represents the formulas

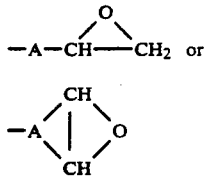

in which A represents an alkyl, alkoxyalkyl, aryl or alkaryl radical and the total of x, y and z is less than 500.

Examples of radicals represented by $R^1$ and $R^2$ are methyl, ethyl and phenyl groups.

Methyl groups are examples of the preferred $R^1$ and $R^2$ radicals.

Examples of the epoxide functional-containing groups Q are

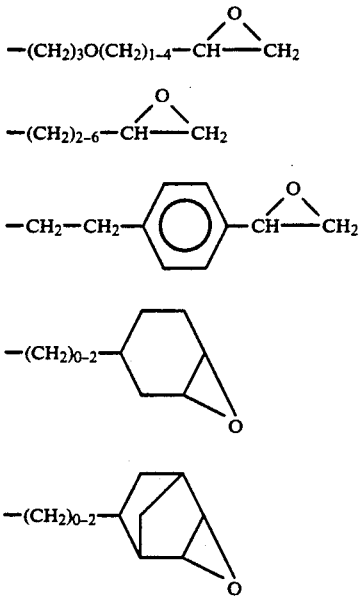

Preferred epoxide functional-containing groups represented by Q are

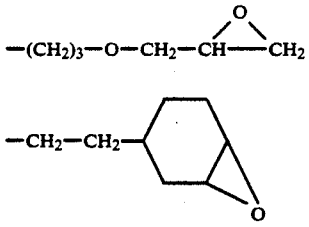

The ratio of the indices x, y and z preferably lies in a range which results in an epoxide value (equivalent/100 g) of 0.4 to 0.015.

Epoxide functional organopolysiloxanes having an epoxide value (equivalent/100 g) of 0.3 to 0.08 are especially preferred.

The viscosity of the epoxide functional organopolysiloxanes employed is 5–50,000 $mm^2/s$ at 25° C.

The viscosity range which is particularly preferred is between 10 and 1000 $mm^2/s$.

The epoxide functional polysiloxanes may be prepared by known methods, for example, by those described in German Auslegeschrift 1,061,321. In these publications, epoxide functional polysiloxanes are synthesized for example via an addition of an unsaturated epoxide, such as allyl glycidyl ether, to the corresponding Si-H-containing polysiloxanes in the presence of a transition metal as a catalyst.

In addition to the epoxide functional organopolysiloxane, the cleaner and/or conditioner of this invention may also contain other components. If additional components are added, then the following composition, which can be either an oil-in-water emulsion or a water-in-oil emulsion, has proved to be particularly effective:

(A) 5–30% by weight, preferably 10–20% by weight of an epoxide functional organopolysiloxane of the present invention;

(B) 0–30% by weight, preferably 1–5% by weight in the case of oil-in water emulsions and preferably 10–20% by weight in the case of water-in-oil emulsions, of a non-reactive organopolysiloxane;

(C) 1–20% by weight, preferably 5–15% by weight, of a surfactant;

(D) 0–50% by weight, preferably 5–30% by weight, of an organic solvent;

(E) 5–25% by weight, preferably 10–15% by weight, of a scouring agent;

(F) 0–10% by weight, preferably 0–4% by weight, of an acid component;

(G) 0–10% by weight, of additional additives, selected from the group consisting of thickeners, preservatives, dyes and odorants;

(H) 1–89% by weight of water.

The non-reactive organopolysiloxanes (B) are preferably dimethylpolysiloxanes having trimethylsilyl groups, cyclic dimethylpolysiloxanes, octamethylcyclotetrasiloxanes, decamethylcyclopentasiloxanes or mixtures thereof.

The surfactants (C) are preferably anionic surfactants, for example, alkylsulfonates, alkylbenzenesulfonates, sulfosuccinates and non-ionogenic surfactants, for example, alkyl polyglycol ethers, fatty acid polyglycol esters, alkylaryl polyglycol ethers, polyethoxylated fatty acid glycerides, polyglycerol fatty acid esters, polyethoxylated sorbitan esters, fatty acid alkylolamides, polydiorganosiloxane-polyoxyalkylene copolymers and the like. These surfactants result inter alia in the stabilization of the emulsion, support cleansing of the surface and improve protective-film formation.

The organic solvents (D) are hydrocarbon-based solvents, for example, petroleum ethers, or they are alcohols, for example, isopropanol and ethanol.

The scouring component (E) serves to reinforce the cleansing action and can be any finely divided powder which brings about the desired scouring effect. Examples of suitable scouring substances are aluminum oxide, quartzes, siliceous chalk, diatomaceous earth, colloidal silicon dioxide, sodium metasilicate or talc.

Organic and inorganic acids are used as the acid component (F). Examples of suitable acids are acetic acid, citric acid, amidosulfonic acid, acidic sulfates, phosphates and phosphoric acid esters.

The compositions of this invention may also contain other additives (G), selected from the group consisting of thickeners, preservatives, dyes and odorants.

The emulsion formulations may be prepared by any suitable mixing technique and are distinguished by a particularly long shelf life and a strong action. To prepare an oil-in-water emulsion, an oil phase is first formed from components (A) and (C) as well as, if appropriate, from (B) and (D) which is then treated with the aqueous phase (H) with constant stirring. The components (E) and, if appropriate, (F) and (G) are then successively dispersed into the emulsion. In the case of a water-in-oil emulsion, an oil phase is likewise first formed from components (A) and (C), and if appropriate, from (B) and (D), into which the aqueous phase containing the remaining components is dispersed with constant stirring.

In the cleaning and/or conditioning process the cleaner and/or conditioner of this invention is applied on the dry glass-ceramic surface to be treated with the aid of a cloth and rubbed in.

If a 100 percent epoxide functional organopolysiloxane is used, then the epoxide functional organopolysiloxane is applied to the clean, if necessary already precleaned, glass-ceramic surface. Liquid household cleaners known per se which are suitable for cleaning glass-ceramic surfaces, can be used for the precleaning of the glass-ceramic surface. Synthetic, as well as natural fabrics, are suitable textile carrier materials for absorbing the epoxide functional organopolysiloxane. The active substance may be applied to the fabric by immersion, padding, spraying or brushing, using the active substance in 100 percent pure form or diluted with a suitable solvent such as hydrocarbons or chlorohydrocarbons, and then dried. The amount applied is 1 to 100 percent, based on the weight of the carrier material, but preferably 5 to 50 percent. To avoid the loss of the active substances during transport and storage, the treated cloth is preferably sealed in a plastic film.

Following the cleaning and/or conditioning process, the glass-ceramic surface is polished. The polishing, giving rise to a protective film free from streaks and resistant to wet wiping, is accomplished rapidly and easily using the agent of this invention without any unpleasant smearing. After treatment, the glass-ceramic surface has a cared-for, shining surface and has long-term protection against the burning-on of food residues, especially foodstuffs with a high sugar content.

The protective film is highly resistant both to heat and to the effect of water-containing surfactants.

In the following examples all percentages are by weight unless otherwise specified.

EXAMPLE 1

Preparation of a compound of the formula

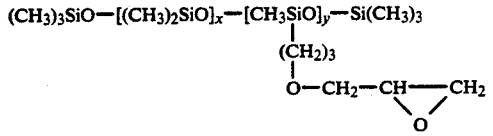

where the ratio of x:y is 4:1. About 629 g (5.5 mol) of allyl glycidyl ether, 520 g of isopropanol, 6 g of powdered $Na_2CO_3$ and 10 ml of a 1 percent by weight solution of hexachloroplatinic acid in isopropanol are placed in a reaction flask which was purged with nitrogen for 15 minutes. The reaction mixture is then heated at 90° C. (reflux) with constant stirring, and 1500 g of a liquid dimethylmethylhydrogensiloxane copolymer terminally blocked with trimethylsilyl groups, having a viscosity of 12 $mm^2/s$ (25° C.) and an Si-H content of 62.2 $cm^3$ of $H_2/g$ are slowly added dropwise. The nitrogen purging is continued during this process. When all of the copolymer is added (the addition taking about 1 hour), the reaction mixture is refluxed for an additional 2 hours and checked at regular intervals for residual Si-H content which had dropped to no more than 0.05 $cm^3$ of $H_2/g$ during the reaction. The mixture is then cooled to 80° C., treated with activated carbon and filtered. After removal of the solvent at 120° C. and 2 mbar, 1980 g of a colorless organopolysiloxane are obtained having the following properties:

Viscosity (25° C.): 50 $mm^2/s$

Epoxide value (equivalent/100 g): 0.22

EXAMPLE 2

Preparation of a compound of the formula

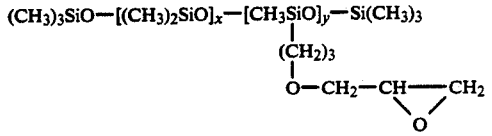

where the ratio of x:y is 8:1. About 325 g (2.85 mol) of allyl glycidyl ether, 275 g of isopropanol, 4.5 g of powdered $Na_2CO_3$ and 6 ml of a 1 percent by weight solution of hexachloroplatinic acid in isopropanol are placed in a reaction flask which was purged with nitrogen for 15 minutes. The reaction mixture is then heated at 90° C. (reflux) with constant stirring, and 1500 g of a liquid dimethylmethylhydrogensiloxane copolymer terminally blocked with trimethylsilyl groups, having a viscosity of 54 $mm^2/s$ (25° C.) and an Si-H content of 38.8 $cm^3$ of $H_2/g$ are slowly added dropwise. The nitrogen purging is continued during this process. When all of the copolymer is added (the addition taking about 1 hour), the reaction mixture is refluxed for an additional 2 hours and checked at regular intervals for residual Si-H content which had dropped to no more than 0.05 $cm^3$ of $H_2/g$ during the reaction. The mixture is then cooled to 80° C., treated with activated carbon and filtered. After removal of the solvent at 120° C. and 2 mbar, 1800 g of a colorless organopolysiloxane are obtained having the following properties:

Viscosity (25° C.): 140 $mm^2/s$

Refractive index (25° C.): 1.418

Epoxide value (equivalent/100 g) 0.16

EXAMPLE 3

Preparation of a compound of the formula

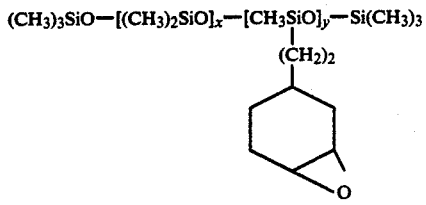

x:y = 4:1

About 690 g (5.5 mol) of 3,4-epoxycyclohexylethylene, 530 g of isopropanol, 5. 3 g of powdered $Na_2CO_3$ and 10 ml of a 1 percent by weight solution of hexachloroplatinic acid in isopropanol are placed in a reaction flask which was purged with nitrogen for 15 minutes. The reaction mixture is then heated at 90° C. (reflux) with constant stirring, and 1500 g of a liquid dimethylmethylhydrogensiloxane copolymer terminally blocked with trimethylsilyl groups, having a viscosity of 12 $mm^2/s$ (25° C.) and an Si-H content of 62.2 $cm^3$ of $H_2/g$, are slowly added dropwise. The nitrogen purging is continued during this process. When all of the copolymer is added (the addition taking about 1 hour), the reaction mixture is refluxed for an additional 2 hours and checked at regular intervals for residual Si-H content which had dropped to no more than 0.05 $cm^3$ of $H_2/g$ during the reaction. The mixture was then cooled to 80° C., treated with activated carbon and filtered. After removal of the solvent at 120° C. and 2 mbar, 2100 g of a colorless organopolysiloxane are obtained having the following properties:

| | |
|---|---|
| Viscosity (25° C.) | 60 $mm^2/s$ |
| Refractive index (25° C.) | 1.424 |
| Epoxide value (equivalent/100 g) | 0.21 |

EXAMPLE 4

Preparation of a cleaner and/or conditioner composition for glass-ceramic surfaces containing the epoxide functional organopolysiloxane prepared in Example 1 in the form of an oil-in-water emulsion containing the following components:

| | |
|---|---|
| Epoxide functional organopolysiloxane (prepared in Example 1) | 20% |
| Linear dimethylpolysiloxane having a viscosity of 100 $mm^2/s$ at 25° C. | 2% |
| Liquid paraffinic hydrocarbon with a boiling range of 80 to 110° C. | 25% |
| Non-ionogenic emulsifier (for example octylphenol ethoxylate with about 10 ethylene oxide units) | 8% |
| Citric acid | 3% |
| Alumina with a particle size of 1 to 100 μm | 10% |
| Water | 30% |

The organopolysiloxanes, liquid paraffinic hydrocarbon and the emulsifiers are mixed to form an oil phase, and water is then slowly added with constant stirring. At the end, the citric acid and the alumina were dispersed into the emulsion.

A thick oil-in-water emulsion, stable on storage, is obtained.

EXAMPLE 5

Preparation of an oil-in-water emulsion having the same composition as that described in Example 4, except that the product prepared in Example 2 is substituted as the epoxide functional organopolysiloxane.

EXAMPLE 6

Preparation of an oil-in-water emulsion having the same composition as that described in Example 4, except that the product prepared in Example 3 is substituted as the epoxide functional organopolysiloxane.

EXAMPLE 7 (COMPARISON EXAMPLE)

Preparation of an oil-in-water emulsion having the same composition as that described in Example 4, except that an amine functional organopolysiloxane having the following structure is substituted for the epoxide functional organopolysiloxane:

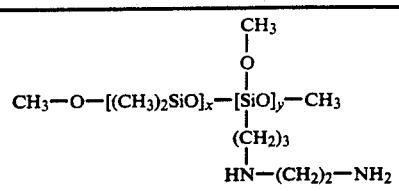

| | |
|---|---|
| Viscosity (25° C.): | 50 $mm^2/s$ |
| Amine value (m equivalent/g): | 1.4 |

EXAMPLE 8

Preparation of a water-in-oil emulsion having the following composition:

| | |
|---|---|
| Epoxide functional organopolysiloxane (described in Example 1) | 10% |
| Cyclic dimethylpolysiloxane having a viscosity of 5.0 $mm^2/s$ at 25° C. (decamethylcyclopentasiloxane) | 15% |
| Isopropanol | 4% |
| Polydimethylsiloxane-polyoxyalkylene copolymer | 1.5% |
| Nonylphenol ethoxylate having about 4 ethylene oxide units | 0.5% |
| Polishing alumina with a particle size of from 1 to 100 μm | 10% |
| Water | 59% |

The epoxide functional organopolysiloxane is mixed with the cyclic organopolysiloxane and the polydimethylsiloxane-polyoxyalkylene copolymer to form a homogeneous mixture. First the isopropanol and then a mixture consisting of water, nonylphenol ethoxylate and polishing alumina are incorporated in the oil phase obtained in this manner with constant stirring.

A thick water-in-oil emulsion, stable on storage, is obtained.

EXAMPLE 9

Comparison testing of the cleaning and conditioning action.

Procedure:

About 1 g of the preparation is applied to a slightly soiled test panel made of decorative glass-ceramic measuring 28 cm×28 cm and the preparation is distributed evenly over its surface. The panel is then polished in a circular motion using a household cloth until the surface appears to be free from streaks.

At this stage, the cleaning action and the resistance to fingerprints of the protective film are assessed.

In order to determine the protective effect, the surface is subsequently scattered with a layer of sugar about 3 mm high and heated until the sugar fully carmelized or carbonized. After cooling, the adhesion of the carmelized sugar, its ease and completeness of detachment from the surface and the condition of the surface in respect to any damage (chips) is assessed.

To test for resistance of the protective film to wet wiping, a part of the pretreated surface is wiped with a wet household cloth prior to the sugar test and the sugar test is repeated in the same manner as previously described.

Table 1 summarizes the results.

TABLE 1

| Example | 4 | 5 | 6 | 7 | 8 |
|---|---|---|---|---|---|
| Shelf-life at 40° C. | Very good | Good | Good | Poor | Good |
| Polishability | Very good | Good | Good | Medium | Very good |
| Cleaning action | Good | Good | Good | Good | Good |
| Resistance to fingerprints | Good | Good | Good | Medium | Very good |
| Resistance to wet wiping | Good | Good | Good | Good | Very good |
| Protective effect (non-stick effect and condition of surface) | Very good | Medium | Good | Poor (some chipping) | Very good |

What is claimed is:

1. A process for cleaning and conditioning a glass-ceramic surface which comprises applying a composition containing from 5 to 100 percent by weight based on the weight of the composition of organopolysiloxanes having epoxide groups to the glass ceramic surface.

2. The process of claim 1, wherein the composition contains epoxide functional organopolysiloxane having a unit of the general formula $$R_d(RO)_eQ_fSiO_{\frac{4-(d+e+f)}{2}}$$

and a unit selected from the group consisting of the formulas $$R_aSiO_{\frac{4-a}{2}}, \quad \text{(I)}$$

and $$R_b(RO)_cSiO_{\frac{4-(b+c)}{2}} \quad \text{(II)}$$

in which R is a hydrocarbon group, Q is an epoxide functional group selected from the group consisting of the formulas

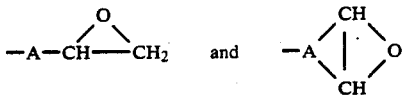

in which A is selected from the group consisting of an alkyl, alkoxyalkyl, aryl and alkaryl radical; a is 1, 2 or 3; b is 0, 1 or 2; C is 1 or 2; d is 0, 1 or 2; e is 1 or 2; and f is 1 or 2 with the proviso that the totals of b and c and of d, e and f are no greater than 3.

3. The process of claim 1, wherein the composition contains epoxide functional organopolysiloxanes having the formula $$(CH_3)_3SiO[(CH_3)_2SiO]_x[R^1R^2SiO]_y[QCH_3SiO]_z\text{-}Si(CH_3)_3,$$

where $R^1$ and $R^2$ are selected from the group consisting of an alkyl, aryl and alkaryl radical and Q is selected from the group consisting of the formulas

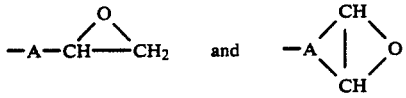

in which A is selected from the group consisting of an alkyl, alkoxyalkyl, aryl and alkaryl radical and the ratio of x, y and z is such that the epoxide value is from 0.4 to 0.015 and the total of x, y and z is less than 500.

4. The process of claim 2, wherein the composition contains epoxide functional organopolysiloxanes are of the formula $$(CH_3)_3SiO[(CH_3)_2SiO]_x[R^1R^2SiO]_y[QCH_3SiO]_z\text{-}Si(CH_3)_3,$$

where $R^1$ and $R^2$ are selected from the group consisting of an alkyl, aryl and alkaryl radical and Q is selected from the group consisting of the formulas

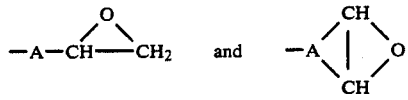

in which A is selected from the group consisting of an alkyl, alkoxyalkyl, aryl and alkaryl radical and the ratio of x, y and z is such that the epoxide value is from 0.4 to 0.015 and the total of x, y and z is less than 500.

5. The process of claim 1, wherein the composition contains (A) from 5 to 30 percent by weight of the epoxide functional organopolysiloxane; (B) 0 to 30 percent by weight of a non-reactive organopolysiloxane; (C) 1 to 20 percent by weight of a surface-active agent; (D) 0 to 50 percent by weight of an organic solvent; (E) 5 to 25 percent by weight of a scouring agent; (F) 0 to 10 percent by weight of an acid component; (G) 0 to 10 percent by weight of additional additives, selected from the group consisting of thickeners, preservatives, dyes, odorants and mixtures thereof; and (H) 1 to 89 percent by weight of water.

6. The process of claim 2, wherein the composition contains (A) from 5 to 30 percent by weight of the epoxide functional organopolysiloxane; (B) 0 to 30 percent by weight of a non-reactive organopolysiloxane; (C) 1 to 20 percent by weight of a surface-active agent; (D) 0 to 50 percent by weight of an organic solvent; (E) 5 to 25 percent by weight of a scouring agent; (F) 0 to 10 percent by weight of an acid component; (G) 0 to 10 percent by weight of additional additives, selected from the group consisting of thickeners, preservatives, dyes, odorants and mixtures thereof; and (H) 1 to 89 percent by weight of water.

7. The process of claim 3, wherein the composition contains (A) from 5 to 30 percent by weight of the epoxide functional organopolysiloxane; (B) 0 to 30 percent by weight of a non-reactive organopolysiloxane; (C) 1 to 20 percent by weight of a surface-active agent; (D) 0 to 50 percent by weight of an organic solvent; (E) 5 to 25 percent by weight of a scouring agent; (F) 0 to 10 percent by weight of an acid component; (G) 0 to 10 percent by weight of additional additives, selected from the group consisting of thickeners, preservatives, dyes, odorants and mixtures thereof; and (H) 1 to 89 percent by weight of water.

8. The process of claim 5, wherein the composition is an oil-in-water emulsion.

9. The process of claim 5, wherein the composition is a water-in-oil emulsion.

10. The process of claim 4, wherein the composition contains (A) from 5 to 30 percent by weight of the epoxide functional organopolysiloxane; (B) 0 to 30 percent by weight of a non-reactive organopolysiloxane; (C) 1 to 20 percent by weight of a surface-active agent; (D) 0 to 50 percent by weight of an organic solvent; (E) 5 to 25 percent by weight of a scouring agent; (F) 0 to 10 percent by weight of an acid component; (G) 0 to 10 percent by weight of additional additives, selected from the group consisting of thickeners, preservatives, dyes, odorants and mixtures thereof; and (H) 1 to 89 percent by weight of water.

* * * * *